US007572141B2

(12) United States Patent
Sun

(10) Patent No.: US 7,572,141 B2
(45) Date of Patent: Aug. 11, 2009

(54) EXPANSION CARD SOCKET

(75) Inventor: Zheng-Heng Sun, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/036,269

(22) Filed: Feb. 24, 2008

(65) Prior Publication Data

US 2009/0163048 A1 Jun. 25, 2009

(30) Foreign Application Priority Data

Dec. 24, 2007 (CN) ..... 2007 1 0203365

(51) Int. Cl.
*H01R 13/00* (2006.01)

(52) U.S. Cl. ..... 439/485; 439/157; 439/159

(58) Field of Classification Search ..... 439/157, 439/159, 485
See application file for complete search history.

(56) References Cited

U.S. PATENT DOCUMENTS 6,290,519 B1 * 9/2001 Lee ..... 439/157

* cited by examiner

*Primary Examiner*—Truc T Nguyen
(74) *Attorney, Agent, or Firm*—Frank R. Niranjan

(57) ABSTRACT

An expansion card socket used to fix an expansion card includes a main body and a latching member. The main body includes a fixing portion defining a slot for fixing the expansion card, and a clamping portion perpendicularly extending from an end of the fixing portion. The latching member is fixed to the clamping portion. A guiding portion extends from a surface of the latching member and gradually tapers to an edge in a direction away from the fixing portion of the main body, and the guiding portion is configured for guiding airflow to dissipate heat from the expansion card.

13 Claims, 2 Drawing Sheets

EXPANSION CARD SOCKET

BACKGROUND

1. Field of the Invention

The present invention relates to expansion card sockets, and especially relates to an expansion card socket contributing to dissipating heat for an expansion card mounted thereto.

2. Description of Related Art

An expansion card socket generally includes a main body and two tabs. Opposite ends of the socket respectively define a slot for receiving a corresponding tab. Opposite sidewalls of the slot respectively define a hole. Each tab includes a clamping portion and an operating portion extending from a top of the clamping portion. Two shafts respectively extend from opposite sidewalls of the clamping portion. The shafts of each tab are respectively rotatably engaged in the holes of a corresponding slot, thus the tab is fixed to the main body. When an expansion card is mounted to the socket, the tabs respectively resist against opposite ends of the expansion card. Air flows from one end to the opposite end of the socket for dissipating heat. The airflow produces vortexes when passing across a side of a corresponding tab because of the width of the tab. Thus, resistance to the airflow increases when the air flows through the socket, thereby reducing heat dissipation.

What is needed, therefore, is to provide an expansion card socket that contributes to dissipating heat for an expansion card mounted thereto.

SUMMARY

An exemplary expansion card socket used to fix an expansion card includes a main body and a latching member. The main body includes a fixing portion defining a slot for fixing the expansion card, and a clamping portion perpendicularly extending from an end of the fixing portion. The latching member is fixed to the clamping portion. A guiding portion extends from a longitudinal side of the latching member and gradually tapers to an edge in a direction away from the fixing portion of the main body, and the guiding portion is configured for guiding airflow to dissipate heat from the expansion card.

Other advantages and novel features will become more apparent from the following detailed description when taken in conjunction with the accompanying drawings, in which:

DETAILED DESCRIPTION

Figure 1:
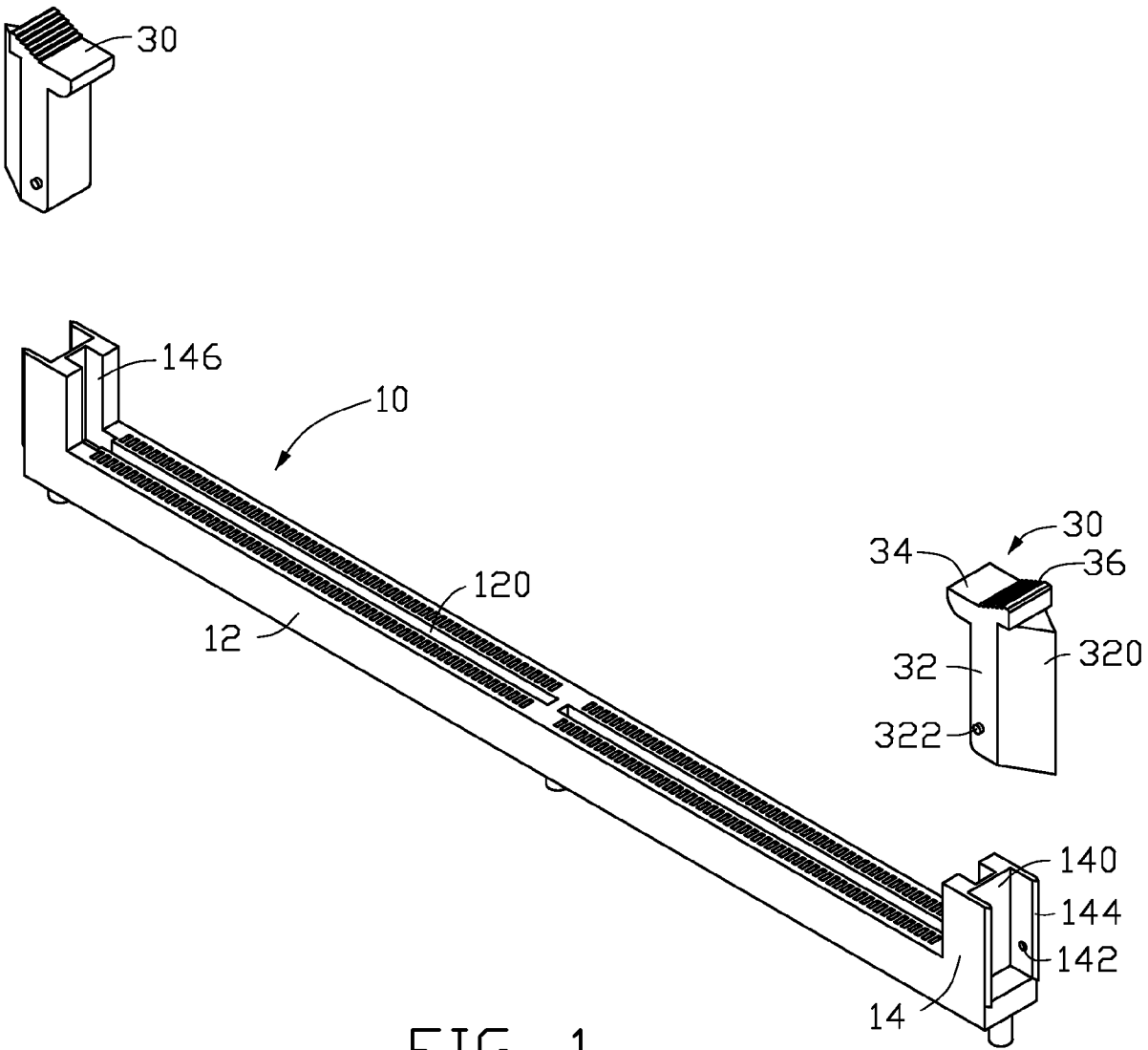
FIG. 1 is an exploded, isometric view of an expansion card socket in accordance with an embodiment of the present invention.

Referring to FIG. 1, an expansion card socket for fixing an expansion card (not shown) according to an embodiment of the present invention includes a main body 10, and two latching members 30.

The main body 10 includes a bar-shaped fixing portion 12 and two clamping portions 14 respectively perpendicularly extending up from opposite ends of the fixing portion 12. A top surface of the main body 10 defines a slot 120 therein for fixing a bottom of the expansion card. Each clamping portion 14 defines a receiving slot 146 in an inner side thereof communication with the slot 120, and a mounting slot 140 opposite to the receiving slot 146 in an outer surface thereof. Two opposite sidewalls of each mounting slot 140 respectively define a hole 142 therein. A rectangular matching portion 144 with a beveled edge extends out from a longitudinal side of each sidewall of the mounting slot 140, away from the corresponding receiving slot 146.

Each latching member 30 includes a securing portion 32 with a prism-shaped guiding portion 320 extending from a longitudinal side surface thereof. The securing portion 32 includes an inner surface to abut against the outer surface of the mounting slot 140 when the latching member 30 is rotated upright. The guiding portion 320 includes two tapered guiding surfaces extending out from two opposite longitudinal sides of the inner surface of the securing portion 32, and gradually tapered to an edge in alignment with and within the same plane of the slot 120 to reduce resistance to the airflow. Therefore. the guiding portion 320 between the edge and the two opposite longitudinal sides is configured to guide air flowing from said end of the fixing portion 12 to an opposite end of the fixing portion 12. A block 34 extends from a top of the securing portion 32 facing the slot 120, and an operating portion 36 extends from the top of the securing portion 32, away from the block 34 and above the guiding portion 320. Two shafts 322 respectively extend from low portions of the longitudinal sides of the securing portion 32.

Figure 2:
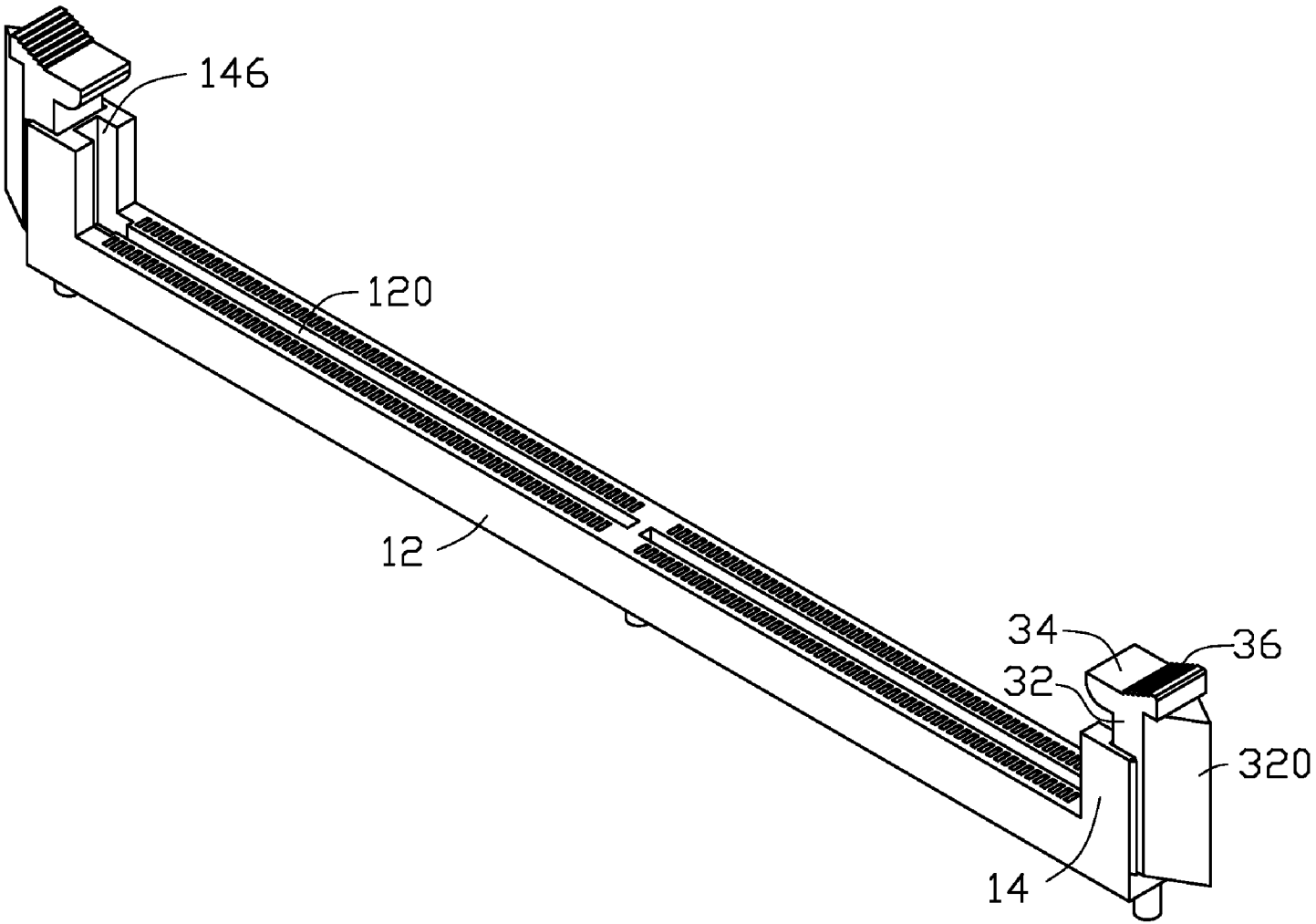
FIG. 2 is an assembled view of FIG. 1.

Referring also to FIG. 2, in assembly, the shafts 322 of the securing portions 32 of each latching member 30 are respectively engaged in the corresponding holes 142 of the main body 10, and thus the latching member 30 is pivotably mounted to the main body 10. In assembling the expansion card, the bottom of the expansion card is engaged in the slot 120 of the fixing portion 12 of the main body 10. Opposite ends of the expansion card are respectively received in the receiving slots 146 of the corresponding clamping portions 14. The operating portions 36 of the latching members 30 are respectively driven to move towards the expansion card, until the blocks 34 resist against a top of the expansion card. Thus, the expansion card is fixed. The beveled edges of the matching portions 144 of the clamping portion 14 conforming to the shape of opposite sides of the prism-shaped guiding portion 320 are abutted against the opposite sides of the guiding portion 320 forming a smooth surface and together acting as a guiding member for guiding airflow.

In use, air flows across a corresponding latching member 30 easily because of the tapered contour of the guiding member of the latching member 30.

In a second embodiment, an inner surface of each sidewall of the matching portions 144 is flat, and an outer surface adjacent a longitudinal distal side of each sidewall is slanted.

In a third embodiment, the guiding portion 320 and the matching portions 144 each can be a detachable prism-shaped portion.

It is believed that the present embodiments and theirs advantages will be understood from the foregoing description, and it will be apparent that various changes may be made thereto without departing from the spirit and scope of the invention or sacrificing all of its material advantages, the examples hereinbefore described merely being preferred or exemplary embodiments.

What is claimed is:

1. An expansion card socket for fixing an expansion card comprising:

a main body comprising a bar-shaped fixing portion defining a slot for receiving a bottom of the expansion card, and a clamping portion perpendicularly extending up from an end of the fixing portion; and a latching member comprising a securing portion rotatable mounted to an outer surface of the clamping portion for assisting in fixing the expansion card, a guiding portion extending from a longitudinal side of the securing portion, the guiding portion gradually tapering to an edge in a direction away from the fixing portion of the main body, for guiding airflow to dissipate heat from the expansion card, wherein the edge of the guiding portion is in alignment with and within the same plane of the slot.

2. The expansion card socket as claimed in claim 1, wherein two shafts respectively extend from low portions of opposite longitudinal sides neighboring the guiding portion of the securing portion, the clamping portion defines a mounting slot in the outer surface thereof, opposite sidewalls of the mounting slot define two holes therein, for rotatably receiving the shafts of the securing portion.

3. The expansion card socket as claimed in claim 2, further comprising two matching portions with flat inner sidewalls and beveled edges, wherein the matching portions respectively extend out from distal sides of the sidewalls of the mounting slot.

4. The expansion card socket as claimed in claim 3, wherein the matching portions of the clamping portion abut against opposite sides of the securing portion, the matching portions, and the guiding portion cooperate to guide airflow.

5. The expansion card socket as claimed in claim 1, wherein a receiving slot configured for receiving a corresponding end of the expansion card is defined in the clamping portion away from the latching member, an operating portion extends from a top of the latching member away from the receiving slot above the guiding portion, for being operated when assembling or disassembling the expansion card.

6. The expansion card socket as claimed in claim 1, wherein a block extends from a top of the latching member for clipping a top of the expansion card.

7. An expansion card socket for fixing an expansion card, the expansion card socket comprising:

a main body comprising a bar-shaped fixing portion defining an elongated slot for receiving a bottom of the expansion card, and a clamping portion perpendicularly extending up from an end of the fixing portion; and an elongated latching member having an end rotatably mounted to an outer surface of the clamping portion, wherein the latching member is capable of assisting in fixing the expansion card when the latching member is rotated upright to be substantially parallel to the clamping portion;

wherein the latching member comprises an inner surface to abut against the outer surface of the clamping portion when rotated upright, and an outer surface extending out from two opposite longitudinal sides of the inner surface and gradually tapered to an edge, thereby forming two tapered guiding surfaces between the edge and the two opposite longitudinal sides capable of guiding air flow from said end of the fixing portion to an opposite end of the fixing portion.

8. The expansion card socket as claimed in claim 7, wherein the edge is parallel to a direction along which the expansion card is inserted into the slot.

9. The expansion card socket as claimed in claim 7, wherein two shafts respectively extend from the longitudinal sides of the latching member at said end of the latching member, the clamping portion defines a mounting slot in the outer surface thereof, opposite sidewalls of the mounting slot define two holes therein, for rotatably receiving the shafts of the latching member.

10. The expansion card socket as claimed in claim 9, further comprising two matching portions with flat inner sidewalls and beveled edges, wherein the matching portions respectively extend out from distal sides of the sidewalls of the mounting slot.

11. The expansion card socket as claimed in claim 10, wherein the matching portions of the clamping portion abut against the longitudinal sides of the latching member, to cooperate with the two tapered guiding surfaces to guide airflow.

12. The expansion card socket as claimed in claim 7, wherein a receiving slot configured for receiving a corresponding end of the expansion card is defined in the clamping portion facing the slot, an operating portion extends from a top of the latching member away from the receiving slot above the two tapered guiding surfaces, for being operated when assembling or disassembling the expansion card.

13. The expansion card socket as claimed in claim 7, wherein a block extends from a top of the latching member for clipping a top of the expansion card.

* * * * *